US006948286B2

(12) United States Patent
Hystad

(10) Patent No.: US 6,948,286 B2
(45) Date of Patent: Sep. 27, 2005

(54) METHOD AND SYSTEM FOR DECK AND RAIL CONSTRUCTION USING WOOD COMPOSITES

(76) Inventor: Garth Aaron Hystad, 6215 Spurwood Dr., Colorado Springs, CO (US) 80918

( * ) Notice: Subject to any disclaimer, the term of this patent is extended or adjusted under 35 U.S.C. 154(b) by 315 days.

(21) Appl. No.: 09/776,530

(22) Filed: Feb. 3, 2001

(65) Prior Publication Data

US 2002/0062606 A1 May 30, 2002

Related U.S. Application Data

(60) Provisional application No. 60/180,050, filed on Feb. 3, 2000, and provisional application No. 60/183,902, filed on Feb. 22, 2000.

(51) Int. Cl.[7] ..... E04F 11/16

(52) U.S. Cl. ..... 52/177; 52/263; 52/588.1; 52/783.11; 52/763.17; 52/783.19

(58) Field of Search ..... 52/177, 181, 403.1, 52/480; 256/65, 66, 19

(56) References Cited

U.S. PATENT DOCUMENTS

| | | | | |
|---|---|---|---|---|
| 1,363,413 A | | 12/1920 | Hester | |
| 3,229,433 A | * | 1/1966 | Miles | |
| 3,484,827 A | * | 12/1969 | Hall | |
| 3,822,053 A | * | 7/1974 | Daily | 256/22 |
| 3,955,801 A | * | 5/1976 | Sorieo, Jr. | 256/65 |
| 4,007,919 A | * | 2/1977 | Totten | 256/59 |
| 4,540,160 A | * | 9/1985 | Zamavich et al. | 256/19 |
| 4,885,882 A | * | 12/1989 | Forshee | 52/177 |
| 4,907,387 A | * | 3/1990 | Turnbull | 52/177 |
| 5,553,427 A | * | 9/1996 | Andres | 52/177 |
| 5,601,278 A | * | 2/1997 | Graber | 256/66 |
| 5,613,339 A | * | 3/1997 | Pollock | 52/731.1 |
| 5,617,697 A | | 4/1997 | Erwin | |
| 5,642,592 A | | 7/1997 | Andres | |
| 5,702,090 A | * | 12/1997 | Edgman | 256/19 |
| 5,713,171 A | * | 2/1998 | Andres | 52/263 |
| 5,758,467 A | | 6/1998 | Snear et al. | |
| 5,787,664 A | | 8/1998 | Hollander et al. | |
| 5,791,100 A | | 8/1998 | Schieferly et al. | |
| 5,803,438 A | * | 9/1998 | Blouin | 256/66 |
| 5,862,642 A | | 1/1999 | Erwin | |
| 5,950,377 A | | 9/1999 | Yoder | |
| 6,009,682 A | | 1/2000 | Lehman et al. | |
| 6,017,019 A | | 1/2000 | Erwin | |
| 6,029,954 A | * | 2/2000 | Murdaca | 256/59 |
| 6,061,991 A | * | 5/2000 | Dahl | 52/720.2 |
| 6,092,350 A | | 7/2000 | Dumlao et al. | |
| 6,108,998 A | | 8/2000 | Dulmao | |
| 6,299,142 B1 | * | 10/2001 | Chaney et al. | 256/65 |
| 6,374,555 B1 | * | 4/2002 | Gusler | 52/177 |
| 6,453,630 B1 | * | 9/2002 | Buhrts et al. | 52/177 |
| 6,544,596 B2 | * | 4/2003 | Clemens et al. | 427/407.1 |

OTHER PUBLICATIONS

Web page; Armor–Rail Deck and Stair Railing Systems by Sharkespeare; Jan. 2, 2000; 3 pages.
Web page; Answer Sheet for Armor–Rail Deck and Stair Railing Systems by Shakespeare; Jan. 2, 2000; 7 pages.
Web page; ChoiceDek; Jan. 2, 2000; 1 pg.
Web page; Trex Guard by Trex Company, LLC; Jan. 2, 2000; 1 page.

(Continued)

*Primary Examiner*—Jeanette Chapman
*Assistant Examiner*—Yvonne M. Horton
(74) *Attorney, Agent, or Firm*—Susan D. Campbell; Holme Roberts & Owen LLP

(57) ABSTRACT

The invention involves a system and method for constructing decks, adapted for use with wood composite materials. The invention may include the application of facing to cover the materials used in forming the outer edge or rim of the deck and the underlying deck support members. Additionally, the invention may include railing structures that involve a combination of wood composite and metal elements, coordinated with other deck features.

26 Claims, 4 Drawing Sheets

OTHER PUBLICATIONS

Web page; Fencing Appendix A by Trex Company, LLC; Jan. 2, 2000; 1 page.
Composite and vinyl decking materials cut down on maintenance by Glenn Haeg; The Handyman; Jan. 2, 2000; 3 pages.
Web page; Remarkable Redwood Railings by California Redwood Association, Jan. 2, 2000; 7 pages.
Web page; Richard Henofer Decks by Trex Company, LLC; Jan. 2, 2000; 4 pages.
Web page; Rumber Materials Inc.—Product Brochure; Jan. 2, 2000; 3 pages.
Web page; TimberTech Extrusions by TimberTech Limited; Jan. 2, 2000; 3 pages.
Web page advertisement; Decking System ad placed by Michael I. Kroll; 2 pages.

Web page; Vinyl Deck & Railing System by Kroy Building Products, Inc.; 2 pages.

Web page; Vinyl Deck & Railing System by Kroy Building Products, Inc., 2 pages.

Web page; Vinyl Deck & Railing System by Kroy Building Products, Inc. 2 pages.

Web page; Vinyl Deck & Railing System by Kroy Building Products, Inc. 1 page.

* cited by examiner

METHOD AND SYSTEM FOR DECK AND RAIL CONSTRUCTION USING WOOD COMPOSITES

CROSS REFERENCE TO RELATED APPLICATIONS

This is a non-provisional application which claims priority from provisional application Ser. No. 60/180,050 filed Feb. 3, 2000 and provisional application Ser. No. 60/183,902 filed Feb. 22, 2000, both by inventor Garth A. Hystad, and these applications are incorporated herein by reference.

BACKGROUND

The residential and commercial construction industry has increasingly used wood composite materials in place of traditional wood building products. Such wood composite materials are typically comprised of recycled plastics (such as polyethylene) and recycled wood products and are formed by extrusion or other techniques into wood composite boards, panels, and decorative pieces. Wood composite building materials offer several advantages, including resistance to moisture and insects so reducing the rotting, cracking, warping and splintering characteristic of wood products.

Wood composite products have been applied to form the floor boards and other elements of decks, floors, steps, walkways, bridges, and other architectural and landscaping features where wood has ordinarily been used. Many wood composite products used in construction have a hollow or non-solid core. Cutting a wood composite board, for example, may expose the non-solid interior, including internal structural features intended to provide strength. Wood composite materials that have been cut in construction can chip at the edges, and the edges may be sharp. Exposing the interior core design of composite materials may also be considered unattractive.

SUMMARY OF THE INVENTION

The present invention involves a method and system for construction of a deck system especially adapted for use with wood composite building materials. In one aspect of the invention, the invention is a deck system, including a plurality of floor members forming a deck with an outer edge, a deck support means connected to such floor members, and a first facing means attached to said outer edge and formed to cover at least a portion of the outer edge. The floor members may be comprised of wood composite material or synthetic wood material. The facing means may be formed of metal, and a preferred embodiment is aluminum. The facing means may be coated with a surface finish means for preserving the facing means and for presenting a selected exterior color. The surface finish means may have a color to coordinate with the color of other elements of the deck. In one embodiment of the invention, the surface finish is a power paint material.

In another aspect of the invention, the invention includes a second facing means positioned to cover at least a portion of the deck support means. The first facing means and second facing means may each be coated with a surface finish means and in a preferred embodiment they are both formed from metal and the surface finish means is a powder paint applied to both first and second facing means.

In another aspect of the invention, the deck support means includes first and second deck support members. In one embodiment, these deck support members may be formed of natural wood products. In yet another aspect of the invention, the invention includes fastening means for connecting the first facing means to the outer edge of the deck. The fastening means may include a screw inserted through the first facing means into at least one of the side walls forming a portion of the outer edge. The fastening means may also be an adhesive. The invention may include a facing support member connected to said first deck support member and positioned to form a slot proximate to a portion of the plurality of floor members forming the outer edge of the deck, wherein the first facing means has a slot member extending away from its inner surface, and being sized to be inserted into and frictionally engage the slot. This provides a way of attaching the facing means to the outer edge without having to insert a nail or screw into the floor members, which provides an advantage when the floor members are wood composite material.

In another aspect of the invention, the invention includes a railing means that is positionable along the outer edge of the deck. The railing means may include first and second posts connected to the deck and a rail structure attached to the posts and formed and sized to inhibit the movement of people. The rail structure may include upper and lower horizontal cross members—each having a first end connected to the first post and a second end connected to the second post. The cross members may be formed of wood composite materials, or metal. The posts may be formed of a material selected from a group consisting of metal, plastic, natural wood product and wood composite. The railing means may also include a plurality of balusters, connected to the horizontal cross members. The balusters may be formed of a material selected from a group consisting of metal, plastic, natural wood product, glass product and wood composite. A preferred baluster material is metal. The invention may include an approach for connecting the cross members to the posts, and balusters to the cross members, that avoids the use of screws or nails and so is well-adapted to use with composite materials.

The invention may include applying a surface finish to each of the first and second facing means and said balusters. In a preferred embodiment, the first and second facing means, and the plurality of balusters, are metal, which provides a suitable foundation for a surface finish including powder paint material. In turn, in another aspect, this facing and baluster surface finish may be coordinated with the finish applied to other elements of the deck including the deck floor members and railing cross members, to produce an integrated color scheme. The use of metal cross members or balusters in combination with wood composite materials for other elements of the railing means, and the rest of the deck, produces the advantage of a low maintenance deck. Further, the use of facing means, especially metal facing means, may provide a protective cover over exposed cut ends of floor members and other deck elements, which may reduce the effects of wear and tear, and maintenance costs.

BRIEF DESCRIPTION OF THE DRAWINGS

These and other features, aspects, and advantages of the present invention will become better understood with regard to the following description, appended claims and accompanying drawings where:

DESCRIPTION OF THE INVENTION

Figure 1A:
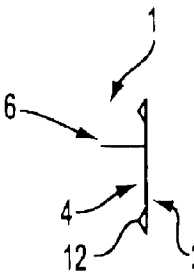
FIG. 1 depicts one embodiment of the invention, including the attachment of double layered facing to the outer rim of a deck and to a step.

The present invention involves the construction of deck systems including the use of wood composites, and approaches to applying facing and railing elements coordinated with other deck elements, including wood composite materials.

The present invention involves a method and system for the application of a metal facing (also called facia) to wood composite building materials. The invention contemplates that the facing may be applied to cut or uncut surfaces of wood composite products. The metal facing may be comprised of metal, including but not limited to steel, zinc, or aluminum. Aluminum is a preferred constituent. Applying the facing to cut edges and other surfaces of wood composite products exposed to foot and other traffic protects the composite material from damage. Such facing also provides a uniform smooth surface for application of paint and decorative features in coordination with other architectural elements. The use of a metal (as opposed to wood, plastic, or composite) facing provides special advantages, including increased resistance to adverse weather and wear and tear.

The invention contemplates that the metal facing may be applied to a cut or uncut wood composite surface in many ways, including the use of clips, adhesive materials, or traditional nails or screws. The present invention does not intend to limit the invention to specific methods of attachment.

In one embodiment of the invention, the method involves attaching metal facing to wood composite materials using a system which avoids nails or screws. The use of nails or screws with composite materials may not be desired because certain composite building products do not have solid cores, and for this reason and in some cases due to the composition and strength of the composite, composite building products may not hold nails or screws well. One embodiment of the invention, presented in the context of deck and step construction with wood composite materials, is depicted in FIG. 1. In this embodiment, the facing 1 is comprised of a thin sheet of metal, such as aluminum. As is seen in view A of FIG. 1, the facing 1 has an outer surface 2 and an inner or back surface 4 which covers the surface of the composite material, such as cut edges of composite floor boards. The back surface 4 of the facing may be designed to include also a thin lip 6 attached to the back surface 4, and extending away from the surface as shown in view A. The lip 6 may form about a 90° angle with the back surface 4 of the facing, or may form an angle of another size, depending on the system for attachment and design of the deck or other construction. Typically, the facing may be aligned to cover the exposed cut or uncut composite material, and the lip permits attachment of the facing to cover the composite material without nails or screws. As seen in view B of FIG. 1, in the case of deck construction, for example, the deck floor boards 7 (decking) may be cut so that, at the edge or rim of the deck, the non-solid core is exposed. The deck floor boards 7 are typically supported by one or more wooden deck support members (or joists) 8 lying underneath them. A support member 10 for the facing may be attached to the deck support member 8 so that a narrow space is formed between the bottom surface of the composite floor boards 7 and the top of the support member 10 for the facing; the surfaces surrounding this space are sized to accommodate and hold the lip 6 of the metal facing 1, which is inserted into the space. The lip 6 may then be pushed snugly into the space, bringing the back surface of the facing close to or in contact with the exposed edge surface of the composite floor boards 7 of the deck. The distance between the support member 10 for facing and the bottom of the composite floor boards 7 maybe sized to be slightly greater than the width of the lip 6 of the metal facing to provide for a close fit. The length of the lip 6 may be adjusted as a function of the size and weight of the facing to provide adequate anchoring for the facing. In this embodiment, the facing lip 6 may be slipped into the area formed by bottom surface of the composite floor boards 7 and the top surface of the support member 10 for the facing, so that there is no need for the facing to be nailed or screwed to the composite material or any of the support members. The facing may be sized to cover all or part of the exposed edge of the composite floor boards 7, the underlying support member 10 for facing, and one or more of the deck support members 8.

Figure 1E:
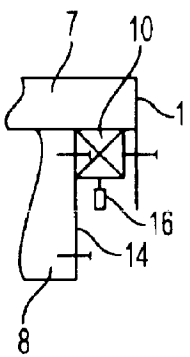
Figure 1C:
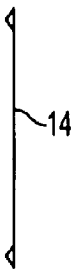
Figure 1F:
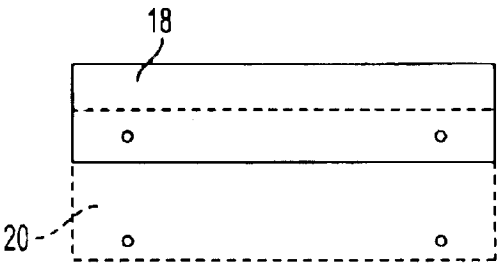

The lip 6 of the facing 1 may be produced by bending a section of a metal sheet used to form the facing back against the back surface 4 of the facing 1, and then bending the lip 6 to extend outwards (in the present embodiment, at an angle of about 90° to the back surface 4 of the facing). The bottom edge of the facing may also be bent or rolled back to create a smooth edge 12. The facing 1 and its lip 6 may also be formed by extrusion, molding or casting. A powder coating may be applied to the facing for protection of the surface of the facing, and for decorative purposes. Optionally, as seen in FIG. 1E, a lighting fixture or strip 16 may be attached behind the facing 1, to the facing support member 10, the deck support 8, or between the facing support member 10 and the facing 1.

Figure 1B:
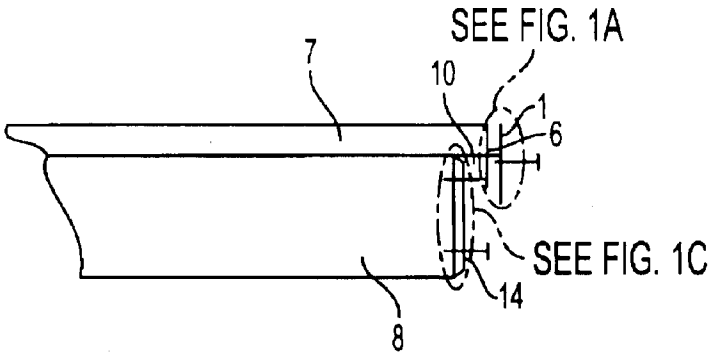
Figure 1G:
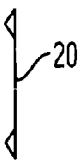
Figure 1D:
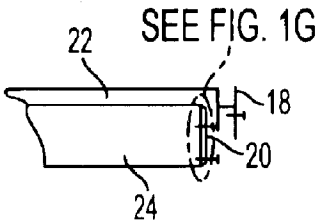

As depicted in FIGS. 1B and 1G, in another embodiment, the metal facing 14 may be attached to the deck support member 8. In a preferred embodiment in the context of deck construction depicted in FIGS. 1B and 1C, a first layer of facing 1 covers the composite deck floor board 7 edges, and the facing support member 10, while a second layer of facing 14 covers the deck support member 8. This produces a two-tiered or double facing, and allows for a uniform finish to be created for both layers of facing, avoiding the lack of continuity in finish and color that occurs when the deck floor boards are comprised of composite materials and the support members are made of wood (the composite and wood have a different surface texture, and different capacity to absorb stain and other coloring or finishing materials). It should be noted that natural wood products are often preferred for use as structural support members such as the deck supports that underlie and support the composite floor boards.

When a two-tiered or double facing is used, the lower layer of facing 14 may cover the entire outer face of the deck support member 8 (as in view E of FIG. 1), or only a part of such outer face. The facing 14 may be attached to the deck support member 8 by any of several methods, such as by nailing or screwing the facing to the support member. In one embodiment, the facing may be sandwiched between the deck support member 8 and the facing support member 10, as also shown in view E of FIG. 1. In another embodiment, the method may involve not only covering the edge of composite deck floor boards 7 with facing 1 by inserting a lip of the facing 1 between a facing support member 10 and the bottom surface of the composite floor boards 7, but also by nailing or screwing the lower portion of the facing 1 to the facing support member 10. See view E of FIG. 1.

Figure 2A:
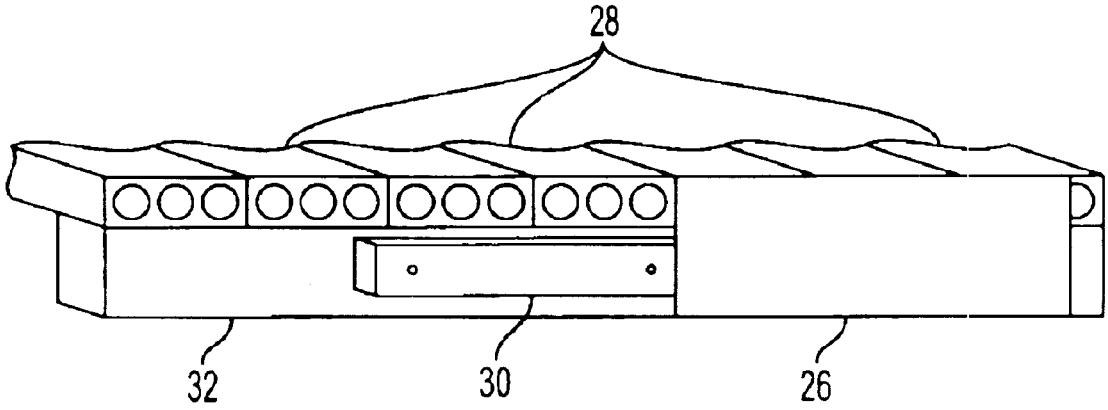
FIG. 2 depicts another embodiment of the invention, including the attachment of single layered facing to the outer rim of a deck.
Figure 2B:
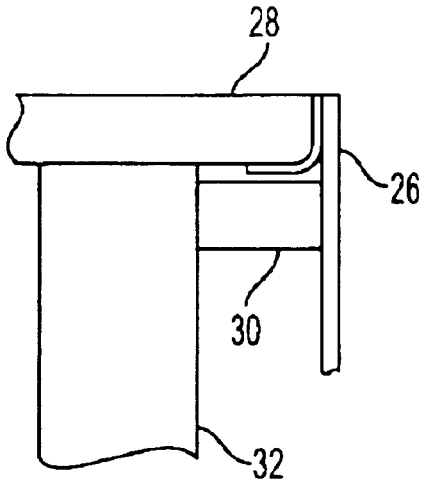

In another aspect of the invention, single or double metal facing 18, 20 may be used to cover the edge of composite steps 22 and wood or composite risers 24 used in step or stair construction. See views D, F and G of FIG. 1. The invention may be applied to other areas in which it is desired to cover and/or finish the edges of composite floor boards, rail elements, panels, and decorative pieces. FIG. 2 (see views A and B) depicts another embodiment of the invention, in which a single piece of metal facing 26 is applied to cover the cut edge of composite floor boards 28, and facing 30 and deck support members 32.

In yet another aspect of the invention, where a railing system is used to enclose all or a portion of a deck, all or part of the elements of the railing may be wood composite materials. The present invention envisions also a method and system for integrating one or more horizontal metal bars into the railing system (joining the vertical posts of the railing) for purposes of enhancing structural strength of the composite railing system. The method includes inserting the ends of one or more metal bars (hollow or solid metal construction) into drilled holes in the wood composite vertical posts of rail or fence construction. In another embodiment, the method may also involve the insertion of one or more vertical metal bars as balusters connecting horizontal wood composite rail members. The use of metal horizontal and vertical members in wood composite rail construction may offer advantages over conventional wood or wood composite members, for reasons of structural strength and ease of formation of the bars, especially if the other members of the rail construction are all or partially wood composites, but also because a metal surface may be conducive to a different and wider variety of paint colors and finishes than wood or wood composite, thus serving the purpose of providing the builder with a broader spectrum of options for color schemes.

Another aspect of the invention involves a method and system for forming a railing system which utilizes one or more members formed of composite materials. A railing system may be comprised of at least one segment, which in turn is comprised of at least two vertical posts and at least two horizontal cross members, and wherein each of the cross members is connected to the two vertical posts at opposite ends of the cross members. A railing system, such as may be used in residential or commercial deck construction, will often have one or more railing segments joined together, in which each segment shares the vertical posts of adjoining segments. Ordinarily, the cross members of a railing segment are attached to the vertical posts at a ninety degree angle, although the angle of attachment may vary. One embodiment of the method and system of the present invention involves the use of cross members comprised of wood composite material, in combination with vertical posts comprised of wood (such as redwood), metal, plastic, or another non-composite material.

In a preferred embodiment, the method involves forming at least one segment of a railing system by constructing at least two cross members comprised of composite material, second constructing two posts of a wood, preferably redwood, and attaching each of the cross members to the posts. In this aspect of the invention, there will be an upper cross member and a lower cross member, both of which are attached at opposite ends to the posts. In another embodiment of the invention, three or more cross members may be used. The posts are preferably vertically aligned, and the cross members are preferably horizontal, at right angles to the posts. In addition, in a preferred embodiment of the invention, two cross members accommodate one or more vertical balusters. The balusters are preferably comprised of metal, but may also be comprised of another material, such as wood, plastic, wood composite, or a glass product. The balusters increase the weight load which must be supported by the cross members, and supported also by the connection between the composite cross members and the vertical posts. In another embodiment of the invention, the cross members and the posts may be comprised of wood-polymer composite materials, while the balusters are metal, plastic, wood, glass, or another material other than wood-polymer composite.

The present invention involves, as a further aspect, and preferably in the context of the railing system described above, a method and system for attaching the composite cross members to the posts, which provides an advantage of avoiding the use of clips, screws, nails or other fastening devices that must penetrate the composite material of the cross members. This method provides an improved approach for connecting cross members comprised of composite material, particularly those supporting heavy balusters, to posts of the railing system. The method may be used with composite cross members of solid composite construction, or composite cross members having one or more hollow interior spaces.

In this aspect, the deck railing system is formed by constructing at least two cross members comprised of composite material as described above, second constructing two posts comprised of wood, preferably redwood, and forming two attachment members comprised of wood-polymer composite material for connection to the inner face of each of the two posts. Forming the attachment members comprises cutting out two slots in the composite material of each of the attachment members. Each of the attachment members is intended to be connected to one of the posts, and so that each of the attachment members has an upper and a lower end aligned with the upper and lower segments of the post. One slot will be cut at the upper end, and the other slot will be cut at the lower end, of each of the vertical posts. In a preferred embodiment, the method comprises cutting each of the slots to accommodate the full height and width of the ends of the composite cross members, which will be inserted into the slots. The slot on the upper end of each of the attachment members is preferably a y-shaped or fork construction, with two "prongs." The slot on the lower end of each of the vertical members is preferably not a y-shaped or fork construction, but rather is closed, so that the bottom surface of the composite cross member, when inserted in the slot, rests on the bottom surface of the slot. Other methods of configuring the slots may be used; for example, the slot at the upper end of a vertical member may be formed several inches from the top of the member, by routering out a rectangular enclosure shaped to fit the structure of the cross member, that is not open at the top. In a preferred embodiment, each end of the two horizontal cross members is fully inserted into a slot on a vertically aligned attachment member, such that the interior composite surfaces of the slot fully and snugly enclose the end of the cross member. The method further comprises connecting each vertical attachment member to the inner face (which faces the horizontal cross members) of a vertically aligned post. This may be done preferably with screws, but may be accomplished with other forms of attachment, such as glue, nails, pegs, or clips, alone or in combination. The slots may be formed by routering or drilling, or other methods of cutting composite material.

The invention further envisions a method and system for attaching balusters to the upper and lower horizontal cross members. This involves drilling, routering or otherwise cutting the composite material of each of the cross members to form a slot or space into which the ends of the balusters may be inserted. This method avoids the use of nails, screws, clips or other similar devices on the cross members. The method involves also cutting slots for the balusters in the upper cross member to a depth that may accommodate some sag or bending of the lower composite cross member under the weight of the balusters and that may prevent the open ends of the balusters from dropping out of the slots in the upper cross member in the event such sag or bending occurs. The present invention may be applied to railing systems of various dimensions, including systems having multiple railing segments, as well as gates, steps or stairs, and other structures, which may use a rail having composite cross members.

In another aspect of the invention, the method may involve also forming the composite cross members so that their length does not exceed a length beyond which significant sag or bending may occur. The calculation of the appropriate length of the cross members will be a function of several factors, including the weight and number of balusters, the dimensions and composition of the cross members (what density and form of wood composite is used), and the method of attachment of the cross members to the vertical posts.

Figure 3C:
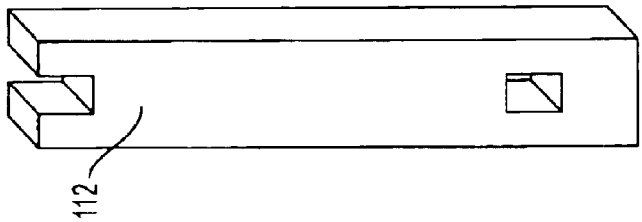
FIG. 3 depicts a further embodiment of the invention, including a railing means.
Figure 3A:
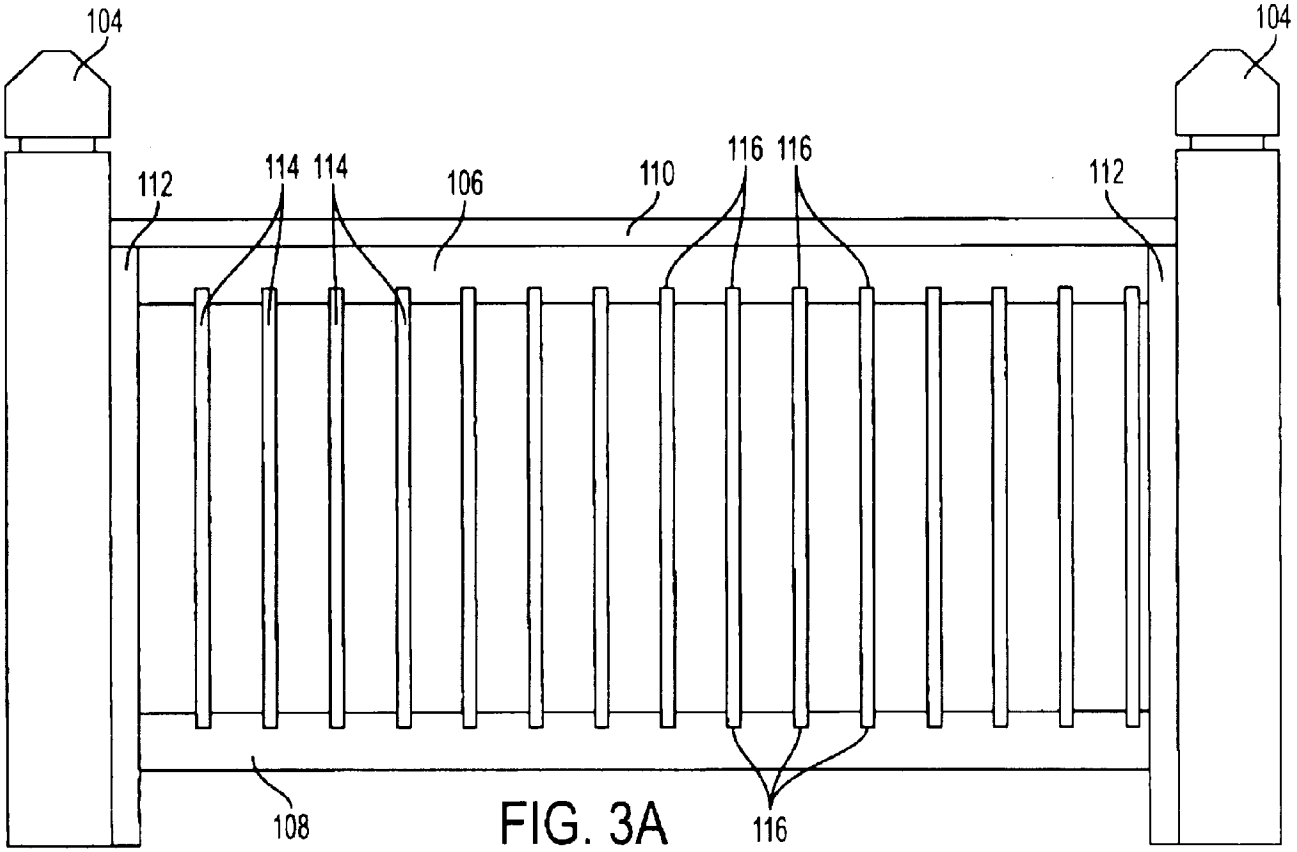
Figure 3B:
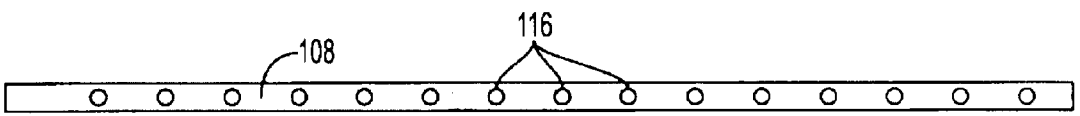
Figure 4C:
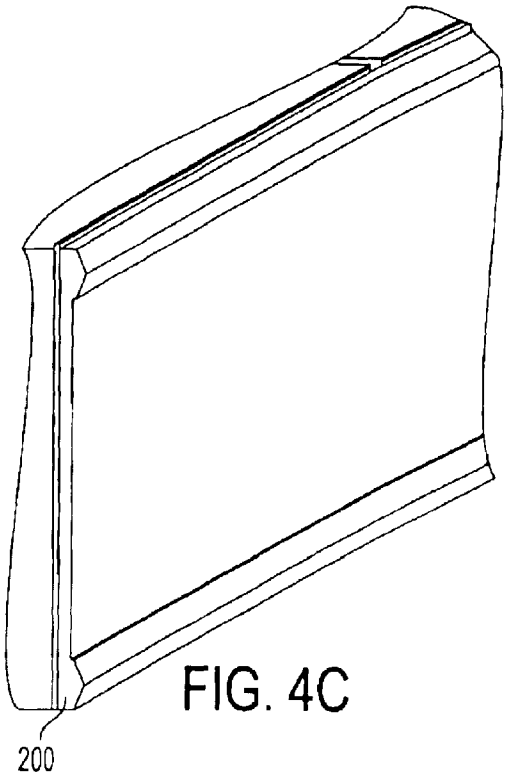
FIG. 4 depicts a further embodiment of the invention, including a facing means for attachment to a deck.
Figure 4F:
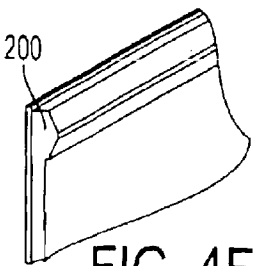
Figure 4B:
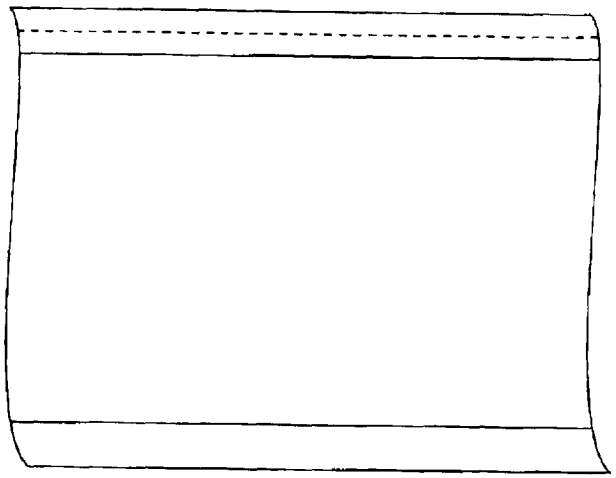
Figure 4E:
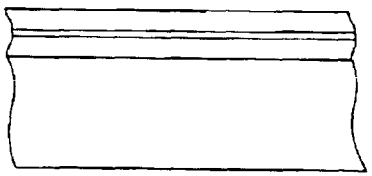
Figure 4A:
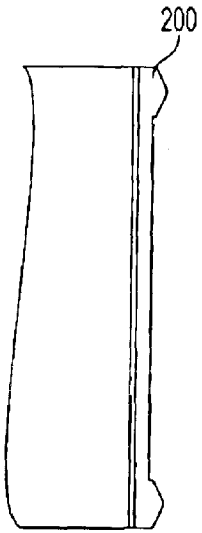
Figure 4D:
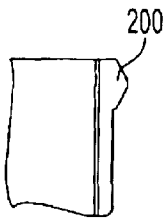

The attached FIG. 3 depicts one embodiment of the invention, in which the posts 104 are 6"×6" redwood posts, and an upper cross member 106 and lower cross member 108 are formed from 2"×4" wood-polymer composite boards. A 2"×6" wood-polymer composite hand rail 110 is applied on top of the upper cross member. Two attachment members 112 are formed from a 2"×6" wood-polymer composite board, and are connected by screws to the inner surface of each post 104. The upper cross member 106 and lower cross member 108 are then inserted in slots cut in each attachment member. Two views of a 2"×6" attachment member 112 are depicted. Balusters 114, preferably comprised of powder-coated metal tubing, are inserted into the two cross members 106 and 108; spaces or slots are routered into the cross members 106 and 108 to accommodate the balusters 114. The slots in the upper cross member 106 are cut to a depth that allows the balusters to drop slightly with sag or bending in the lower cross member 108, without failing out of the slot. In the embodiment depicted in FIG. 3, it is felt that 2"×4" cross members of around five feet in length or less reduce the risk of sag or bending, and promote the structural strength and stability of the railing segment.

The attached FIG. 4 depicts another embodiment of the invention, including a form of facing 200 which may be applied to cover cut or uncut ends of deck floor boards, step elements and other deck elements as discussed above. In a preferred embodiment, the facing is formed of a metal, such as aluminum. The facing 200 may be attached to a cut or uncut step, riser or floor board, or other deck element, using a nail or screw or other similar fastening means. The facing may be sized to cover all or a portion of the rim or edge of a deck, a step, or an underlying riser or deck support member, as examples. FIGS. 4A, 4B and 4C provide side, front and perspective views of beveled edge facing; FIGS. 4D, 4E and 4F provide side, front and perspective view of beveled edge facing with a flattened beveled finish.

The attached FIG. 3 depicts one embodiment of the invention, in which the posts 104 are 6"×6" redwood posts, and an upper cross member 106 and lower cross member 108 are formed from 2"×4" wood-polymer composite boards. A 2"×6" wood-polymer composite hand rail 110 is applied on top of the upper cross member. Two attachment members 112 are formed from a 2"×6" wood-polymer composite board, and are connected by screws to the inner surface of each post 104. The upper cross member 106 and lower cross member 108 are then inserted in slots cut in each attachment member. Two views of a 2"×6" attachment member 112 are depicted. Balusters 114, preferably comprised of powder-coated metal tubing, are inserted into the two cross members 106 and 108; spaces or slots are routered into the cross members 106 and 108 to accommodate the balusters 114. The slots in the upper cross member 106 are cut to a depth that allows the balusters to drop slightly with sag or bending in the lower cross member 108, without failing out of the slot. In the embodiment depicted in FIG. 3, it is felt that 2"×4" cross members of around five feet in length or less reduce the risk of sag or bending, and promote the structural strength and stability of the railing segment.

The attached FIG. 4 depicts another embodiment of the invention, including a form of facing 200 which may be applied to cover cut or uncut ends of deck floor boards, step elements and other deck elements as discussed above. In a preferred embodiment, the facing is formed of a metal, such as aluminum. The facing 200 may be attached to a cut or uncut step, riser or floor board, or other deck element, using a nail or screw or other similar fastening means. The facing may be sized to cover all or a portion of the rim or edge of a deck, a step, or an underlying riser or deck support member, as examples. FIGS. 4A, 4B and 4C provide side, front and perspective views of beveled edge facing; FIGS. 4D, 4E and 4F provide side, front and perspective view of beveled edge facing with a flattened beveled finish.

I claim:

1. A deck system, suitable for use proximate a building on land, comprising:

a deck having a plurality of floor members assembled to define a walking surface for users, each of said floor members being formed of composite material and assembled to have a top surface of composite material, a bottom surface, and at least three sidewalls, said deck walking surface being formed of composite material and said deck having an outer edge formed from the sidewalls of said floor members;

deck support means for supporting each of said plurality of floor members said bottom surface of each of said plurality of floor members being affixed to said deck support means;

first facing means formed to cover at least a portion of said outer edge and attached to one of said outer edge and said deck support means, said first facing means being configured not to extend into said walking surface and said first facing means being formed of metal; and; second facing means positioned to cover and attached to at least a portion of said deck support means.

2. The deck system of claim 1, wherein said metal is aluminum.

3. The deck system of claim 1, wherein said first facing means is coated with a surface finish means for preserving said facing and for presenting a selected exterior color.

4. The deck system of claim 3, wherein said surface finish means has a color selected to coordinate with the color of said deck.

5. The deck system of claim 1, wherein said metal is treated with a powder paint material.

6. The deck system of claim 1, wherein said first facing means and said second facing means are each coated with surface finish means for preserving said facing and for presenting a selected exterior color.

7. The deck system of claim 6, wherein said surface finish means is powder paint.

8. The deck system of claim 1, wherein said deck support means includes a deck support member, and further including a facing support member attached to said deck support member and positioned to form a slot between said facing support member and the lower surface of a portion of said plurality of floor members forming said outer edge of said deck, and wherein said first facing means has an outer surface and an inner surface, and a slot member extending away from said inner surface, said slot member being sized to be inserted into and frictionally engage said slot.

9. The deck system of claim 1, further including railing means positionable along said outer edge to inhibit movement of people over said outer edge of said deck floor, said railing means including first and second posts connected to said deck; and first and second horizontal cross members, each of said cross members having a first end connected to said first post and a second end connected to said second post, said cross members being formed of metal.

10. The deck system of claim 9, wherein said first facing means and each of said cross members are coated with a surface finish means for preserving said facing and for presenting a selected exterior color.

11. The deck system of claim 10, further comprising at least one additional horizontal cross member formed of metal.

12. The deck system of claim 9, wherein said first and second horizontal cross members each have a first end and a second end and are connected to said first post and said second post by an attachment means, said attachment means including, for each of said cross members, two slots formed and sized to fit said first and second ends of said cross member, and wherein said first and second ends are inserted into and frictionally engage said slots.

13. The deck system of claim 1, further including railing means positionable along said outer edge to inhibit movement of people over said outer edge of said deck floor, said railing means including first post and second post connected to said deck; and a lower and an upper horizontal cross member, each cross member connected to said first post and said second post; and a plurality of balusters, each baluster having a first end connected to said lower cross member and a second end connected to said upper cross member, said balusters being formed from metal.

14. The deck system of claim 13, wherein said balusters are connected to said cross members by inserting the first end of each of said balusters in a slot formed in said lower cross member, and by inserting the second end of each of said balusters in a slot formed in said upper cross member.

15. The deck system of claim 13, wherein said balusters and said first facing means are each coated with a surface finish means for preserving said first facing means and said balusters and for presenting a selected exterior color.

16. The deck system of claim 13, wherein said balusters and said first facing means are each coated with a surface finish including powder paint.

17. The deck system of claim 16, wherein said first facing means and said second facing means and each of said balusters are coated with a surface finish for presenting a selected exterior color.

18. The deck system of claim 16, wherein each of said first facing means, second facing means, and each of said balusters is coated with a surface finish including powder paint.

19. The deck system of claim 1, wherein said first facing means is attached to one of said outer edge and said deck support means with screw means.

20. The deck system of claim 1, wherein said second facing means is attached to said deck support means with screw means.

21. The deck system of claim 1, wherein a facing support member is connected to said deck support means and said first facing means is attached to said facing support member.

22. The deck system of claim 1, wherein a facing support member is connected to said deck support means and said second facing means is attached to said facing support member.

23. A deck system, comprising:

a deck having a plurality of floor members assembled to define a walking surface for users, each of said floor members being formed of composite materials and assembled to have a top surface, a bottom surface, and at least three side walls, said deck walking surface being formed of composite material, and said deck having an outer edge formed from the side walls of said floor members;

deck support means for supporting each of said plurality of floor members, said bottom surface of each of said plurality of floor members being affixed to said deck support means;

first facing means formed to cover at least a portion of said outer edge, and attached to one of said outer edge and said deck support means, said first facing means being configured not to extend into said walking surface;

second facing means positioned to cover and attached to at least a portion of said deck support means; and wherein said first facing means and said second facing means are formed of metal.

24. The deck system of claim 23, wherein said first facing means and second facing means are coated with a surface finish means for preserving said facing and for presenting a selected exterior color.

25. The deck system of claim 23, wherein said surface finish means is treatment with powder paint material.

26. The deck system of claim 23, wherein said deck support means includes a deck support member positioned proximate a portion of said outer edge, and further including a facing support member attached to said deck support member and positioned to form a slot between said lower surface of one of said floor members forming said portion of the outer edge of said deck, and wherein said first facing means has an outer surface and an inner surface, and a slot member extending away from said inner surface, said slot member being sized to be inserted into and frictionally engage said slot.

* * * * *